United States Patent [19]

Lane et al.

[11] 4,083,169

[45] Apr. 11, 1978

[54] OPEN-END SPINNING MACHINES

[75] Inventors: Robert Lane, Accrington; John Whiteley, Clitheroe, both of England

[73] Assignee: Platt Saco Lowell Limited, Helmshore, England

[21] Appl. No.: 687,600

[22] Filed: May 18, 1976

[30] Foreign Application Priority Data

May 20, 1975 United Kingdom ..... 21629/75

[51] Int. Cl.[2] ..... D01H 15/00; D01H 1/12

[52] U.S. Cl. ..... 57/34 R; 57/156

[58] Field of Search ..... 57/58.89–58.95, 57/34 R, 156

[56] References Cited

U.S. PATENT DOCUMENTS

| | | | |
|---|---|---|---|
| 3,455,095 | 7/1969 | Makeham et al. | 57/34 R |
| 3,680,300 | 8/1972 | Landwehrkamp | 57/34 R |
| 3,924,393 | 12/1975 | Stahlecker et al. | 57/34 R |
| 3,924,394 | 12/1975 | Stahlecker et al. | 57/34 R |
| 3,925,975 | 12/1975 | Stahlecker et al. | 57/34 R |
| 3,942,311 | 3/1976 | Stahlecker | 57/34 R |

*Primary Examiner*—John Petrakes

*Attorney, Agent, or Firm*—Watson, Cole, Grindle & Watson

[57] ABSTRACT

A method of open-end spinning textile yarn provides the steps during spinning of feeding fibres to a spinning means acting to twist the fibres fed thereto into a tail end of a yarn and withdrawing from the spinning means the continuously formed twisted yarn, and the further step following an interruption in spinning and preparatory to restarting spinning of applying with the spinning means stopped a longitudinal reciprocating motion to the tail end of the yarn to remove excess twist therefrom.

14 Claims, 3 Drawing Figures

OPEN-END SPINNING MACHINES

Figure 1:
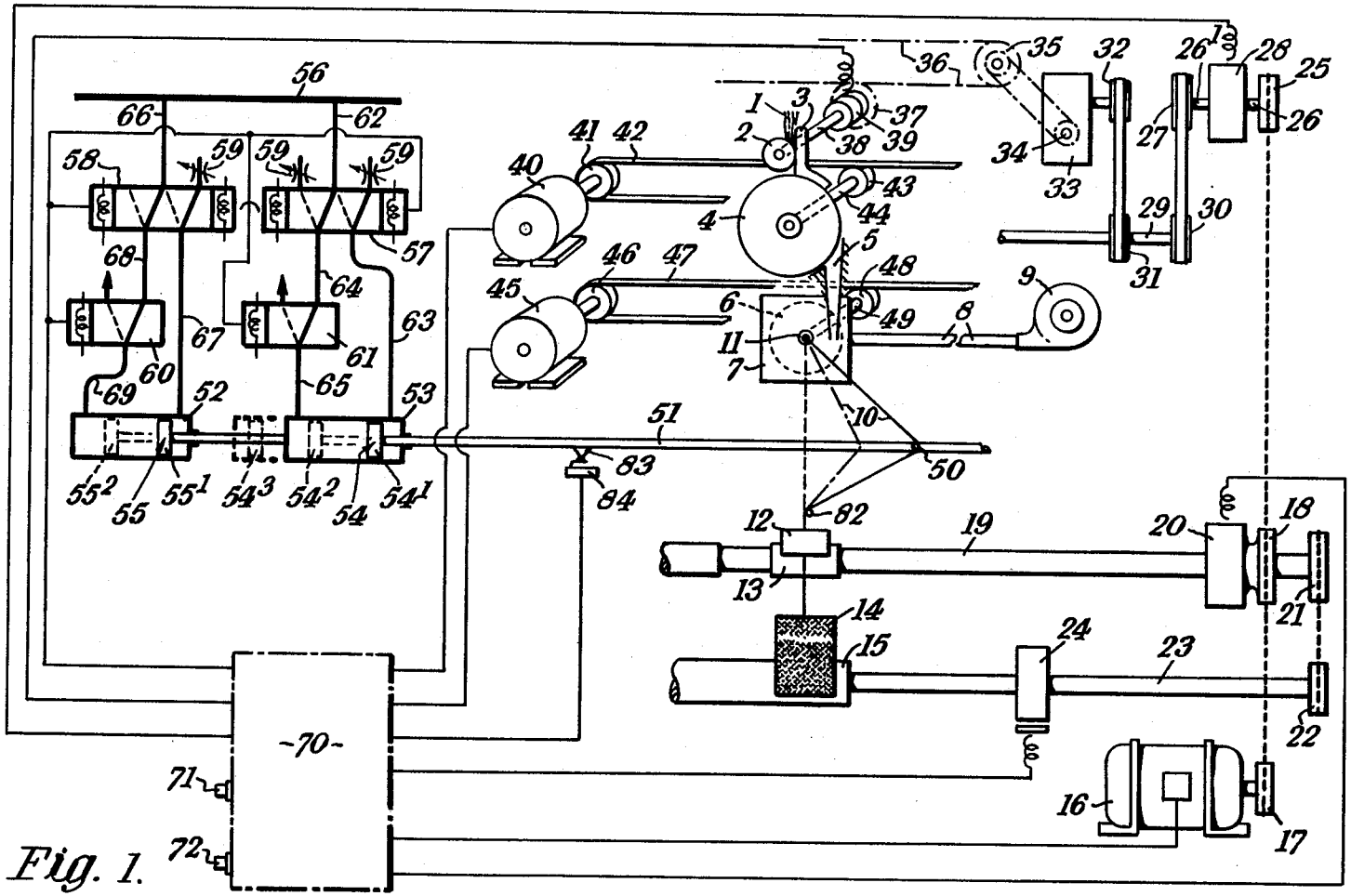

This invention relates to a method of and apparatus for the open-end spinning of textile yarns, and is particularly though not exclusively directed to rotor type open-end spinning.

One of the requirements of an open-end spinning machine is an efficient starting procedure so that each spinning station of the machine is able to commence spinning yarn without incurring yarn breakage.

It is conventional when stopping an open-end spinning machine to allow the spinning rotor to decelerate to rest after terminating delivery of yarn therefrom. It has been found that this results in the formation of highly twisted regions at the end of the yarn remaining in the rotor. On restarting the machine further twist is inserted in the yarn with the result that yarn breakages can occur at the highly-twisted region or the yarn is formed having undesirable characteristics in this region.

According to a first aspect of the invention there is provided a method of open-end spinning textile yarn comprising the steps during spinning of feeding fibres to a spinning means acting to twist the fibres fed thereto into a tail end of a yarn and withdrawing from the spinning means the continuously formed twisted yarn and the further step following an interruption in spinning and preparatory to restarting spinning of applying with the spinning means stopped a longitudinal reciprocating motion to the tail end of the yarn to remove excess twist therefrom.

Preferably, the step of applying a reciprocating motion to the tail end of the yarn takes place in a starting procedure for restarting spinning and precedes the steps of starting the spinning means, starting the feed of fibres to the spinning means and starting the withdrawal of yarn from the spinning means.

The step of applying a reciprocating motion to the tail end of the yarn may alternatively take place in a stopping procedure for stopping spinning and follow the steps of stopping the feed of fibres to the spinning means, stopping the withdrawal of yarn from the spinning means and stopping the spinning means.

In a preferred embodiment of the invention according to said first aspect, continuously formed twisted yarn is withdrawn from the spinning means by yarn delivery means and the method further includes the steps of forming between the spinning means and the yarn delivery means a reserve length of yarn and applying said reciprocating motion to the tail end of the yarn by varying the extent of the reserve length of yarn. Preferably from two to five cycles of the reciprocating motion are applied.

The method according to said first aspect of the invention may include a severing procedure which precedes the step of applying reciprocating motion to the tail end of the yarn and which comprises the step of operating the spinning means with the feeding of fibres and the withdrawal of the yarn stopped, whereby the yarn extending into the spinning means is severed to a predetermined length by application of twist thereto.

Preferably the severing procedure includes as part of a stopping procedure for stopping spinning the steps of stopping the feeding of fibres to the spinning means and the stopping of the withdrawal of yarn from the spinning means and further comprises the step of thereafter continuing operation of the spinning means to sever the yarn by twisting.

According to a second aspect of the invention there is provided an open-end spinning apparatus comprising spinning means operative to twist fibres fed thereto into the tail end of a yarn, fibre feed means for feeding fibres to the spinning means, yarn withdrawal means for withdrawing the continuously formed twisted yarn from the spinning means, and yarn reciprocating means so arranged as to apply, with the spinning means stopped, a longitudinal reciprocating motion to the tail end of the yarn to remove excess twist therefrom.

In a preferred embodiment of the invention according to said second aspect the yarn reciprocating means comprises a reserve length forming means movable from a first position in which it causes or allows the yarn to travel from the spinning means to the yarn withdrawal means in a first path to a second position in which it causes the yarn to travel from the spinning means to the yarn withdrawal means in a second path longer than the said first path to form a reserve length of yarn and means for reciprocating the reserve length forming means between said first and second positions.

In a preferred embodiment of the invention the spinning means comprises a spinning rotor having an internal fibre collecting surface to which fibres are fed and at which they are twisted into said tail end of the yarn, the spinning means being stopped by stopping rotation of the spinning rotor.

Figure 2:
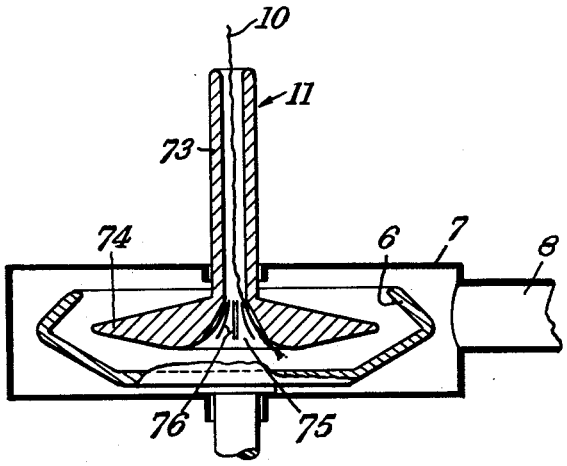
Figure 3:
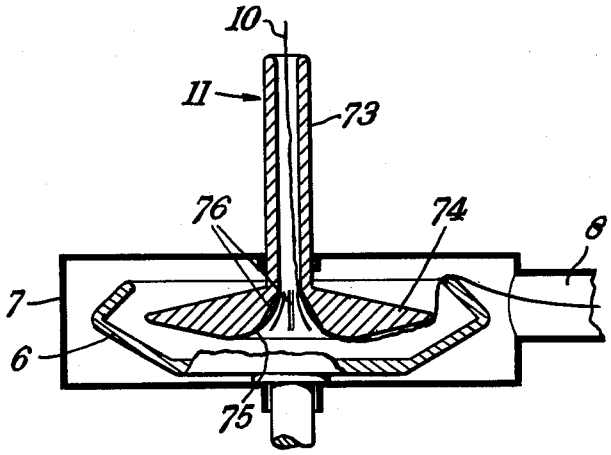

The invention will become more apparent from the following description of a preferred embodiment thereof in conjunction with the accompanying drawings, wherein:

FIG. 1 is a schematic representation of an open-end spinning machine according to the invention, and FIGS. 2 and 3 are schematic cross-sectional views through the spinning rotor of the machine of FIG. 1 indicating two different positions taken by the yarn during operation of the machine.

Only one spinning station is described hereinafter, but it will be appreciated that the machine comprises a plurality of such stations.

Referring to the drawings, at each spinning station a sliver 1 is forwarded between the nip formed by a feed roller 2 and a feed plate 3 to the action of an opening roller 4. The fibres are removed from the opening roller 4 and transferred in an airstream down a fibre feed duct 5 to a spinning rotor 6. The spinning rotor 6 is located within a housing 7 having connected thereto a suction pipe 8 communicating with a suction fan 9 from which the fibre conveying airstream in the fibre feed duct 5 is derived. Spun yarn 10 is withdrawn from the spinning rotor 6 through a doffing tube 11 by a pair of delivery rollers 12, 13 and wound up on a package 14 driven by a driving roller 15.

A main driving motor 16 has a gear wheel 17 fixed to the output shaft thereof. The gear wheel 17 is drivingly connected to a gear wheel 18 mounted on an extension 19 which is drivingly connected to the delivery roller 13 of each spinning unit. Associated with the gear wheel 18 is an electro-magnetic clutch 20 which, when actuated, establishes a connection between the gear wheel 18 and the delivery roller extension 19. The delivery roller extension 19 extends through the clutch 20 and the gear wheel 18 to provide a seating for an output gear wheel 21. The output gear wheel 21 is drivingly connected to a gear wheel 22 fixed on one end of an extension 23 which is drivingly connected to the package driving roller 15 of each spinning unit. An electromagnetically operated brake 24 is also provided on the package driving roller extension 23.

A drive transmission connects the gear wheel 18 with a gear wheel 25 mounted on one end of a countershaft 26 which is connected to a further countershaft 26[1] by means of an electromagnetic fibre feed roller main clutch 28. A pulley 27 is mounted on the end of the countershaft 26[1] from which a drive is transmitted to a layshaft 29 by means of a pulley 30 fixed at one end thereof.

The layshaft 29 extends along the machine and at intervals therealong a pulley 31 is attached to transmit the drive to a pulley 32 mounted on the input shaft of a gear box 33. A pulley 34 mounted on the gear box output shaft transmits the drive to a chain drive wheel 35 driving a chain 36. The chain 36 serves a group of spinning units and at each unit engages a feed roller chain wheel 37 mounted on a feed roller shaft 38 to transmit the drive to the feed roller 2. On each feed roller shaft 38 is an individual feed roller clutch 39.

The drive for the opening roller 4 is derived from an opening roller motor 40 on the output shaft of which is mounted a pulley 41. The pulley 41 drives a driving belt 42 which extends along the machine and at each spinning station contacts an opening roller drive pulley 43 mounted on an opening roller shaft 44 which, in operation, imparts a drive to the opening roller 4.

In a similar manner, the drive for the spinning rotor 6 is derived from a spinning rotor motor 45 on the output shaft of which is mounted a pulley 46. The pulley 46 drives a driving belt 47 which extends along the machine and at each station contacts a rotor drive pulley 48 mounted on a rotor shaft 49 which, in operation, imparts a drive to the rotor 6.

At each spinning station, there is provided the facility for forming a reserve length of yarn and for imparting a reciprocating motion thereto for the purpose to be hereinafter described. FIG. 1 shows the yarn 10 in the maximum reserve length position in which the yarn 10 after emergence from the doffing tube 11 passes around a yarn engaging member 50 formed on a reserve loop or length forming bar 51 and then around a yarn guide 82 prior to the delivery rollers 12 and 13. The reserve length forming bar 51 can be moved to a retracted position so that the yarn 10 follows a shortened path as shown in broken lines, or to an intermediate position so that the yarn is constrained by the yarn engaging member 50 to follow a path indicated by the chain dot line. Movement of the reserve length forming bar 51 is effected by a pair of pneumatic cylinders 52 and 53. The reserve length forming bar 51 is directly connected to a piston 54 of the cylinder 53 and the cylinder 53 is directly connected to a piston 55 of the cylinder 52. The supply of air from a main air supply pipe 56 to the pneumatic cylinder 53 is controlled by an electro-pneumatic control valve 57 and the air supply from the main air pipe 56 to the pneumatic cylinder 52 is controlled by an electro-pneumatic control valve 58. Both of the exhaust ports on the control valve 57 are provided with restricting valves 59, of which only one is provided for the control vale 58, in order to control the rate of exhaust of air from the pneumatic cylinders 52 and 53 and thus the rate of motion of the pistons 54 and 55 within the cylinders 52 and 53. Both of the cylinders 52 and 53 are provided with fast exhaust valves 60 and 61 respectively to allow, as required, rapid motion of the pistons 54 and 55.

An air line 62 connects the main air supply pipe 56 to the control valve 57 which can be connected to a port on the right hand side of the piston 54, as seen in the drawings, through an air line 63 or to a port on the left hand side of the piston 54 through air lines 64 and 65 via the fast exhaust valve 61. Similarly, an air line 66 connects the main air supply pipe 56 to the control valve 58 which can be connected to a port on the right hand side of piston 55 through an air line 67 or to a port on the left hand side of the piston 55 through air lines 68 and 69 via the fast exhaust valve 60.

The operation of the machine is controlled from a control circuit, generally indicated at 70 provided with a start button 71 and a stop button 72. The control circuit 70 includes a stepping switch (not shown) connected with the various electrically operated elements so that they can be controlled in a predetermined manner during stopping and starting the machine as hereinafter described.

Referring now particularly to FIGS. 2 and 3, each Figure shows the spinning rotor 6 mounted within the housing 7 connected to the suction fan 9 (see FIG. 1) by a suction fan 9 (see FIG. 1) by a suction pipe 8. The doffing tube 11 has a tube portion 73 extending out of the housing 7 co-axially with the spinning rotor 6. The doffing tube 11 has a flange portion 74 having a lower surface to control the yarn 10 as it is withdrawn from the spinning rotor 6. The tube portion 73 terminates in the spinning rotor 6 in a flared yarn inlet mouth 75, integral with the flange portion 74, the throat portion of which is provided with a number of grooves 76.

FIGS. 2 and 3 indicate two positions of the yarn at a spinning station. FIG. 2 indicates a yarn severed to the required length with the separated yarn portion being sucked to waste and with the length forming member 51 in the maximum reserve length position and FIG. 3 indicates the position of the yarn with the reserve length forming member 51 in the intermediate reserve length position at the termination of the stopping procedure.

The spinning machine operates in the following manner:

During the spinning operation the sliver 1 is forwarded by the feed roller 2 cooperating with feed plate 3 to the opening action effected by the opening roller 4. The fibres are transferred, in an airstream, down the fibre feed duct 5 to the spinning rotor 6 from which they are withdrawn in the form of spun yarn 10 by the pair of delivery rollers 12, 13 to be wound up on the package 14. Between the doffing tube 11 and the yarn guide 82 the yarn 10 follows the shortened path indicated by the broken line. Thus cylinder 53 will be in the position indicated by the broken lines with the piston 54 in position indicated by 54[3] and the piston 55 in the position indicated by 55[2].

When it is desired to stop the machine, the stop button 72 is depressed to bring into action the stepping switch (not shown) in the control circuit 70 to control automatically the stopping of the machine in accordance with a predetermined sequence. Specifically, the control valves 57 and 58 and the exhaust valves 60 and 61 are actuated to allow air to flow into cylinders 52 and 53 through the left hand ports thus moving piston 55 to position 55[1] which moves the cylinder 53 to the right to the position shown in full lines. The piston 54 is moved to the position 54[1] and thus the reserve loop forming bar 51 moves to the right so that the yarn engaging member 50 causes the yarn to follow the maximum reserve length path as indicated by the full lines. Movement of the yarn to the maximum reserve length path takes place slowly, typically in 10 seconds, by controlling the rate of exhaust from the cylinders 52 and 53 through the restricting valves 59 so that the draft is not affected or the yarn broken. In this position a projection 83 actuates a micro-switch 84 to initiate operation of the stepping switch (not shown) in the control circuit 70 so that the succeeding steps in the stopping procedure takes place automatically.

The main feed clutch 28 is de-energised so that transmission of the drive to the feed roller 2 is interrupted to prevent further feeding of fibres to the spinning rotor 6. The opening roller motor 40 is switched off to allow the opening rollers 4 to decelerate to rest. Delay timers (not shown) in the control circuit 70 are actuated so that the delivery of spun yarn 10 is stopped by energisation of the electro-magnetic brake 24 and de-energisation of the clutch 20 to prevent further rotation of the delivery rollers 12 and 13 and the take-up package driving roller 15.

A predetermined time, say four seconds, after the opening roller motor 40 is switched off, the rotor motor 45 is switched off. Since the yarn is held stationary relative to the spinning rotor this action has the effect of overtwisting and thus severing the yarn at a predetermined position in the region of the mouth 75 of the doffing tube 11. The overtwisting of the yarn is enhanced by the frictional effect exerted on the yarn by the grooves 76 in the throat portion of the mouth 75. As seen in FIG. 2 the separated portion of yarn is sucked away to waste leaving the yarn 10 severed to a predetermined length. After the spinning rotors have stopped rotating the control valve 57 is operated to permit exhaust of air from the left hand port of cylinder 53 under the control of the restricting valve 59. Thus the reserve length forming bar is caused to move slowly to the intermediate position so that the yarn engaging member 50 constrains the yarn 10 to follow the intermediate yarn path as indicated by the chain-dot lines. This allows the end of yarn to be sucked over the rim of the spinning rotor 6 and down the suction duct 8 which ensures that the yarn does not come out of the doffing tube 11 when the suction fan 9 is switched off, as best seen in FIG. 3.

Finally a machine isolator (not shown) and the suction fan 9 are switched off.

To start the machine the suction fan 9 is first switched on to apply suction to the rotor housing 7 through suction pipe 8. The machine isolator (not shown) is actuated to energise the individual feed roller clutches 39 and the electro-magnetic brake 24 and also to start operation of the main driving motor 16.

The start button 71 is depressed and initiates operation of the control valve 57 to allow air from the main air supply pipe 56 to flow to the left hand port of cylinder 53 through air lines 62, 64 and 65 via fast exhaust valve 61. The piston 54 moves to the position $54^1$ and causes the reserve length forming bar 51 to move to the right so that the yarn engaging 50 engages and moves the yarn to the maximum reserve length position in full lines. The yarn 10 is thus partly withdrawn from the spinning rotor 6 to take up a position as indicated in FIG. 2. In this position a projection 83 actuates a micro-switch 84 to initiate operation of the stepping switch (not shown) in the control circuit 70 so that the succeeding steps in the starting procedure take place automatically.

The reserve length forming bar 51 is then caused to reciprocate so that the yarn is alternately caused to follow the intermediate and maximum reserve length paths. To effect this motion the control valve 57 alternatively permits air supply to and air exhaust from the left and right hand ports of cylinder 53 thus causing reciprocation of the piston 54 between the positions $54^1$ and $54^2$. The exhaust outlet on fast exhaust valve 61 is not used at this stage and the air exhaust from the left and right hand ports of the cylinder 53 is under the control of the restricting valves 59 on the exhaust ports of the control valve 57. This action of reciprocating the yarn has the effect of untwisting the over-twist in the overtwisted portions of the yarn which occur particularly at the end of the yarn.

Motion of the reserve length forming bar to the intermediate position causes the yarn to be fed under the influence of the suction further into the rotor by some 60 to 65 mms. whereby the yarn is rubbed against the doffing tube throat, the outer edge of the doffing tube and the rim of the spinning rotor. Motion of the reserve length forming member 51 to the maximum position draws the yarn to the position of FIG. 2 again rubbing the yarn against the doffing tube throat, the outer edge of the doffing tube and the rim of the spinning rotor.

This cycle is repeated preferably from two to five times, depending on yarn count, to untwist the yarn end whereby to remove excess twist. Up to ten cycles can be employed but application of more than five cycles has, in practice, been found to produce little further effect. The step of reciprocating yarn takes place in a relatively short time and in one example the five cycles of reciprocation takes place in 15 seconds. The reserve length forming bar 51 terminates in the maximum reserve length position so that the yarn engaging member 50 constrains the yarn 10 to follow the maximum reserve length yarn path as indicated by the full lines. Thus piston 55 is in the position $55^1$ and the piston 54 is in the position $54^1$.

In some cases it may be desirable to dispense with the intermediate reserve length position and to reciprocate the yarn between the shortened yarn path and an extended yarn path.

The rotor motor 45 is then started thereby causing rotation of the spinning rotors 6 through pulleys 46, 48 and driving belt 47. This is followed by starting the opening roller motor 40 thereby causing rotation of the opening rollers 4 by means of pulleys 41 and 43 and driving belt 42.

The main feed clutch 28 is then energised so that a drive from the motor is transmitted, as explained before, to the feed roller shaft 38. Thus the sliver is forwarded to the action of the opening roller 4 from which the fibres are removed and fed in an airstream to the spinning rotor 6.

The reserve loop forming bar 51 is moved quickly to the shortened path, as shown in broken lines, to enable the yarn to contact and twist in the fibres fed to the spinning rotor 6. To effect this motion, the control valve 57 is actuated so that air is admitted through air lines 62 and 63 to the right hand port of cylinder 53 and also control valve 58 is actuated to admit air through air lines 66 and 67 to the right hand port of cylinder 52. The piston 54 moves to the left of position $54^2$, simultaneously with movement to the left of the piston 55 to position $55^2$. The cylinder 53 is thus moved to the position indicated in broken lines so that piston 54 is further moved to the position $54^3$. Thus the compound movement of the pistons 54 and 55 together with the movement of cylinder 53 allows the yarn to follow the shortened yarn path. During this movement fast exhaust valves 60, 61 are actuated to allow air to exhaust from the left hand ports of cylinders 52 and 53 through air lines 65 and 69. This permits a quick return of the yarn to the spinning rotor 6, and effect a piecing with the fibres fed thereto.

Withdrawal of spun yarn 10 is effected by energisation of the clutch 20 and de-energisation of the brake 24 to cause rotation of the delivery rollers 12 and 13 and also rotation of package driving roller 15 through gear wheels 21 and 22. The spun yarn is thereby collected on the yarn package 14.

The step of reciprocating the yarn has been described as forming part of the starting procedure but it will be appreciated that this step may be performed as part of the stopping procedure. From a technological aspect it is preferable to include this step in the stopping procedure so that all the yarns are in a correct condition for a subsequent starting procedure. However, in practice, it may be necessary to include this step in the starting procedure because of safety reasons.

What we claim as our invention and desire to secure by Letters Patent is:

1. A method of open-end spinning textile yarn comprising the steps during spinning of feeding fibres to a spinning means acting to twist the fibres fed thereto into a tail end of a yarn and withdrawing from the spinning means the continuously formed twisted yarn, and the further step following an interruption in spinning and preparatory to restarting spinning of applying with the spinning means stopped at least two cycles of a longitudinal reciprocating motion to the tail end of the yarn to remove excess twist therefrom.

2. A method according to claim 1, wherein the step of applying a reciprocating motion to the tail end of the yarn takes place in a starting procedure for restarting spinning.

3. A method according to claim 2, wherein the step of applying a reciprocating motion to the tail end of the yarn precedes the steps of starting the spinning means, starting the feed of fibres to the spinning means and starting the withdrawal of yarn from the spinning means.

4. A method according to claim 1, wherein the step of applying a reciprocating motion to the tail end of the yarn takes place in a stopping procedure for stopping spinning and follows the steps of stopping the feed of fibres to the spinning means, stopping the withdrawal of yarn from the spinning means and stopping the spinning means.

5. A method according to claim 1, wherein the continuously formed twisted yarn is withdrawn from the spinning means by yarn delivery means and wherein the method further includes the steps of forming between the spinning means and the yarn delivery means a reserve length of yarn and applying said reciprocating motion to the tail end of the yarn by varying the extent of the reserve length of yarn.

6. A method according to claim 1, including a severing procedure which precedes said step of applying reciprocating motion to the tail end of the yarn and which comprises the step of operating the spinning means with the feeding of fibres and the withdrawal of the yarn stopped, whereby the yarn extending into the spinning means is severed to a predetrmined length by application of twist thereto.

7. A method according to claim 6, wherein the severing procedure includes as part of a stopping procedure for stopping spinning the steps of stopping the feeding of fibres to the spinning means and the stopping of the withdrawal of yarn from the spinning means and further comprises the step of thereafter continuing operation of the spinning means to severe the yarn by twisting.

8. A method according to claim 1 wherein the said spinning means includes a spinning rotor having an internal fibre collecting surface to which fibres are fed and at which they are twisted into said tail end of the yarn and wherein the spinning means is stopped by stopping rotation of the spinning rotor.

9. A method according to claim 8, wherein the spinning rotor is arranged for rotation in a housing connected to a source of suction and wherein during the application of the reciprocating motion the suction is maintained to act upon the tail end of the yarn, whereby the yarn is constrained to rub against at least one member of the spinning means.

10. An open-end spinning apparatus comprising spinning means operative to twist fibres fed thereto into the tail end of a yarn, fibre feed means operative to feed fibres to the spinning means, yarn withdrawal means operative to withdraw the continuously formed twisted yarn from the spinning means, and yarn reciprocating means operative to apply, with the spinning means stopped, at least two cycles of a longitudinal reciprocating motion to the tail end of the yearn to remove excess twist therefrom.

11. Apparatus according to claim 10, wherein the yarn reciprocating means comprises a reserve length forming means operative in a first position to cause or allow the yarn to travel from the spinning means to the yarn withdrawal means in a first path and in a second position to cause the yarn to travel from the spinning means to the yarn withdrawal means in a second path longer than the said first path to form a reserve length of yarn, and means for reciprocating the reserve length forming means between said first and second positions.

12. Apparatus according to claim 10, wherein the spinning means comprises a spinning rotor having an internal fibre collecting surface, wherein said fibre feed means is operative to feed fibres to said fibre collecting surface and wherein said yarn withdrawal means is operative to withdraw yarn continuously from said rotor.

13. A method of open end spinning textile yarn in an open-end spinning apparatus including a rotatable spinning rotor and means for creating a suction effect within the rotor, said method comprising the steps during spinning of feeding fibres to the spinning rotor and withdrawing from the spinning rotor the continuously formed twisted yarn, and the further step following an interruption in spinning and preparatory to restarting spinning of applying at least two cycles of a longitudinal reciprocating motion to the tail end of the yarn to remove excess twist therefrom while applying a suction within the rotor to act upon the tail end of yarn.

14. An open end spinning apparatus comprising a rotatable spinning rotor operative to twist fibres fed thereto into the tail end of a yarn, means for applying a suction effect within said spinning rotor, fibre feed means operative to feed fibres to the spinning rotor, a yarn doffing tube, yarn withdrawal means operative to withdraw the continuously formed twisted yarn from the spinning rotor through the doffing tube, and yarn reciprocating means operative to apply at least two cycles of a longitudinal reciprocating motion to the tail end of yarn while applying a suction effect within the spinning rotor to act upon the tail end of the yarn, whereby the tail end of the yarn is constrained to rub against the yarn doffing tube to remove excess twist therefrom.

* * * * *